US005634554A

United States Patent [19]

Dimarco et al.

[11] Patent Number: 5,634,554

[45] Date of Patent: Jun. 3, 1997

[54] INTERFACE CONNECTION FOR A CIRCUIT BREAKER PLUG-IN TRIP UNIT

[75] Inventors: Bernard Dimarco; David A. Leone, both of Lilburn, Ga.

[73] Assignee: Siemens Energy & Automation, Inc., Alpharetta, Ga.

[21] Appl. No.: 356,944

[22] Filed: Dec. 15, 1994

[51] Int. Cl.[6] ..... H01H 23/00

[52] U.S. Cl. ..... 200/401; 200/400; 335/21; 335/172

[58] Field of Search ..... 200/400, 401, 200/254, 303, 51 R; 335/21, 23, 165, 166, 172, 16, 132; 439/213

[56] References Cited

U.S. PATENT DOCUMENTS

| | | | |
|---|---|---|---|
| 3,559,120 | 1/1971 | Myers . | |
| 4,064,469 | 12/1977 | Gryctko | 335/132 |
| 4,484,164 | 11/1984 | McClellan et al. | 335/16 |
| 4,488,133 | 12/1984 | McClellan et al. | 335/16 |
| 4,513,267 | 4/1985 | McClellan et al. | 335/16 |
| 4,551,697 | 11/1985 | Kussy . | |
| 4,931,603 | 6/1990 | Castonguay et al. . | |
| 4,973,929 | 11/1990 | Duchemin | 335/132 |
| 5,023,416 | 6/1991 | Oyama et al. | 335/16 |
| 5,146,194 | 9/1992 | Altenhof et al. | 335/16 |
| 5,159,304 | 10/1992 | Yamagata et al. | 335/132 |
| 5,258,729 | 11/1993 | Link et al. | 335/132 |
| 5,343,174 | 8/1994 | Turner et al. | 335/16 |
| 5,408,059 | 4/1995 | Goble | 200/51 R |

FOREIGN PATENT DOCUMENTS

| | | |
|---|---|---|
| 0 274 624 | 11/1987 | European Pat. Off. . |
| 0 295 131 | 6/1988 | European Pat. Off. . |
| 839053 | 12/1938 | France . |
| 4 000 206 | 4/1991 | Germany . |
| 2 137 418 | 3/1984 | United Kingdom . |

OTHER PUBLICATIONS

International Search Report (Feb. 4, 1996) For Related PCT/US95/12136.

*Primary Examiner*—David J. Walczak

[57] ABSTRACT

A circuit breaker including a sliding connection between a trip unit and associated contact arm is disclosed herein. The sliding connection facilitates assembly of the circuit breaker and also permits a reduction of size for a circuit breaker of a given rating. An embodiment of the sliding connection includes a blade and jaw assembly connected between the trip unit and contact arm. Another embodiment of the sliding connection includes a blade or jaw assembly slidably connected directly to the contact arm.

4 Claims, 5 Drawing Sheets

INTERFACE CONNECTION FOR A CIRCUIT BREAKER PLUG-IN TRIP UNIT

FIELD OF THE INVENTION

The present invention generally relates to a circuit breaker including a trip unit. More particularly, the present invention relates to a new and innovative electrical connection between the trip unit and the associated circuit breaker.

BACKGROUND OF THE INVENTION

Many modern industrial circuit breakers are configured to include two main components. These components are the circuit breaker switching structure (i.e. frame, mechanical operating mechanism and contact structure) and the trip unit (i.e. electronic or thermal overcurrent monitoring unit). This type of circuit breaker arrangement allows a manufacturer to produce a range of classes of circuit breakers having the same circuit breaker switching structure, but different ratings which depend upon the particular trip unit connected to the switching structure.

Typical and conventional structures used to connect trip units to the switching structure of an associated circuit breaker are bolted/tab connections and flexible braid connections. However, the structure for this arrangement is relatively expensive to manufacture, and assembly thereof during manufacturing is relatively time consuming. Furthermore, such a connection requires a relatively large amount of space for the connection structure and for the assembler to manipulate the structure during assembly.

Accordingly, it would be desirable to provide a structure for electrically connecting a trip unit to a circuit breaker frame which eliminates the bolted tab or flexible braid connections, saves space inside the circuit breaker, simplifies the overall trip unit design, and simplifies circuit breaker assembly.

SUMMARY OF THE INVENTION

The present invention provides a circuit breaker of the type including at least one moving contact arm pivotally connected to a stationary pivot within the circuit breaker, and a trip unit. The circuit breaker includes at least one blade and jaw connection electrically coupled between the contact arm and the trip unit, wherein the blade is slidably engageable with the jaw to permit electrical engagement and disengagement between the trip unit and contact arm while the contact arm remains pivotally connected to the stationary pivot.

Another configuration of the circuit breaker includes a first blade electrically coupled to the trip unit, engaged with the stationary pivot and slidably connected to the contact arm to electrically couple the trip unit to the contact arm while the contact arm remains pivotally connected to the stationary pivot.

The present invention further provides for a circuit breaker including a circuit breaker frame, a contact arm operating mechanism supported by the frame, and a contact arm pivotally supported by a shaft supported by the frame. The contact arm is mechanically coupled to the operating mechanism and the operating mechanism is configured to move the contact arm between an open position and a closed position. The circuit breaker also includes a trip unit configured to activate the operating mechanism to move the contact arm to the open position if the current flowing through the contact arm exceeds a predetermined limit. A first generally flat surface in electrical communication with the contact arm, and a second generally flat surface in electrical communication with the trip unit slidably engaged and conduct electricity between the contact arm and the trip unit, the flat surfaces further being slidably disengagable while the contact arm remains pivotally supported by the shaft.

DETAILED DESCRIPTION OF THE PREFERRED EMBODIMENT

Figure 1B:
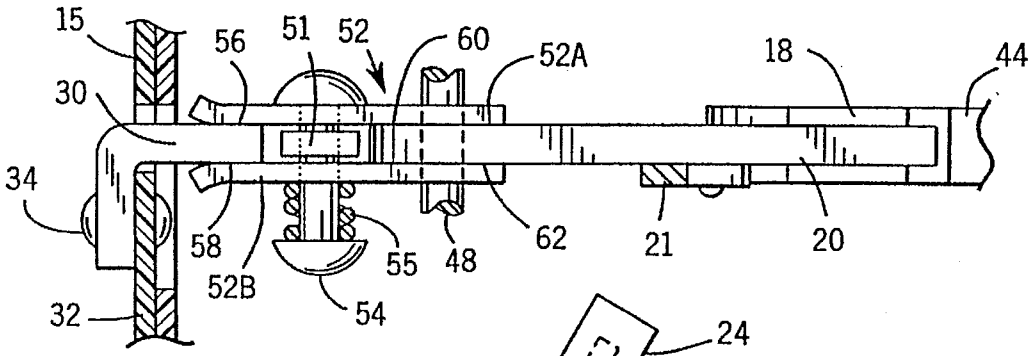
FIG. 1B is a top schematic view of the sliding connection of FIG. 1A.
Figure 1A:
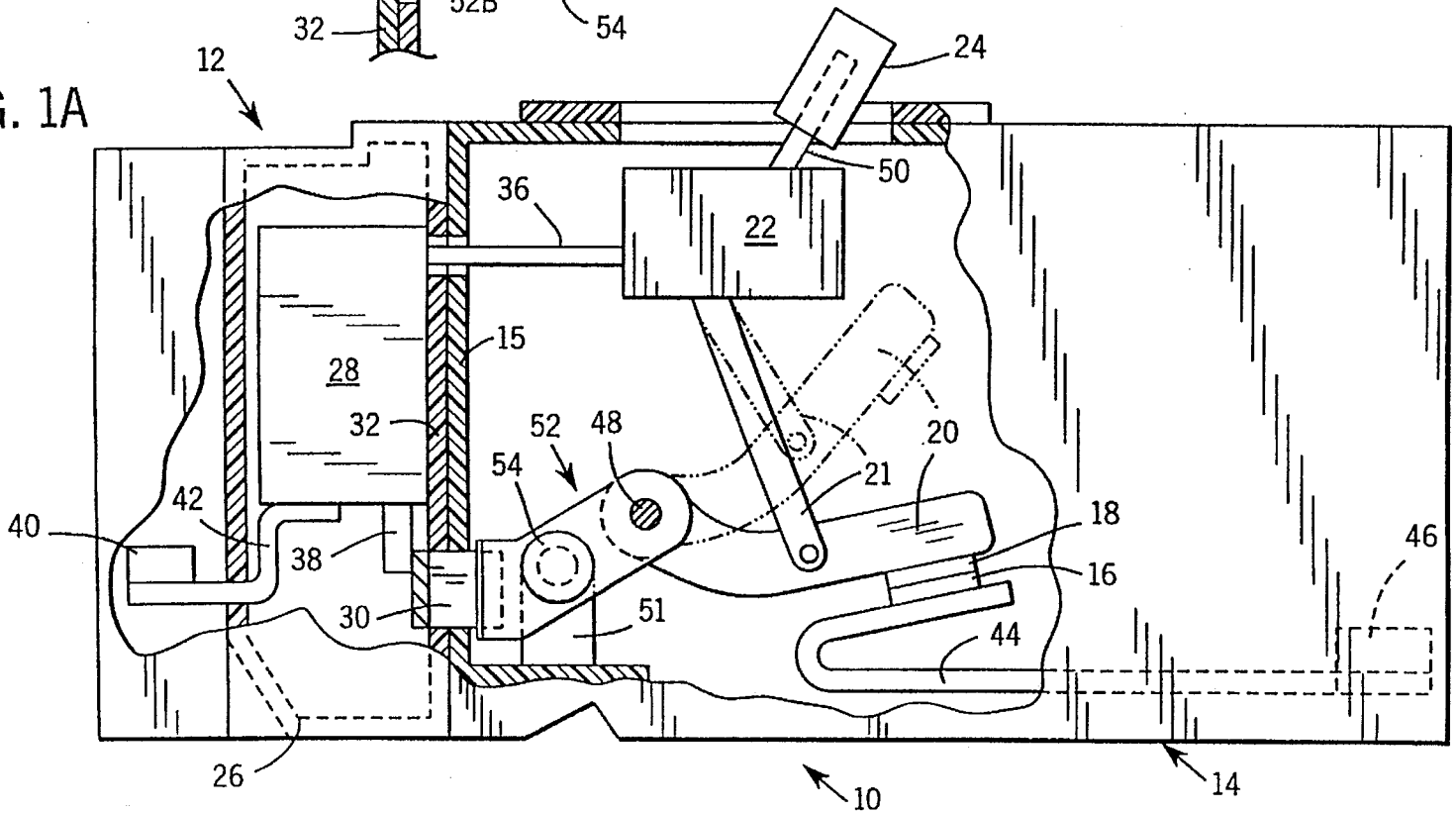
FIG. 1A is a side schematic view of a circuit breaker including a first configuration of a sliding connection between a trip unit and a contact arm.

Referring to FIGS. 1A, 2A, 3A and 4A, a circuit breaker 10 includes a trip unit 12, a circuit breaker frame 14, a stationary contact 16, a moving contact 18, a moving contact arm 20 (20A in FIG. 2A, 20B in FIG. 3A and 20C in FIG. 4A), a contact arm operating mechanism 22, and a circuit breaker operating handle 24. Trip unit 12 includes a trip unit housing 26, and a tripping mechanism 28. In the embodiment of FIG. 1A, unit 12 also includes an electrically conductive L-shaped stab or blade 30. Housing 26 includes a molded plastic outer wall 32 through which L-shaped blade 30 extends. Blade 30 also extends through a wall portion 15 of the circuit breaker housing associated with frame 14. By way of example, blade 30 is supported by wall 32 via a rivet or screw 34 as shown in FIG. 1B only. Blade 30 is electrically connected to tripping mechanism 28 by a conductor 38 as shown in FIG. 1A.

Tripping mechanism 28 may be a conventional thermal-magnetic or electronic trip mechanism, and is coupled to a mechanical link 36 (e.g. push rod or toggle lever arrangment). Mechanical link 36 is also mechanically coupled to contact operating mechanism 22. (The interaction of tripping mechanism 28 and operating mechanism 22 will be discussed in further detail below.) In the embodiment of circuit breaker 10 illustrated in FIG. 1A, trip unit 12 also includes and physically supports a load terminal 40 which is electrically connected to tripping mechanism 28 by an electrical conductor 42.

Frame 14 commonly includes the structure which supports the components of circuit breaker 10. Depending upon the configuration of circuit breaker 10, frame 14 may include a support structure formed integrally with the housing of circuit breaker 10 such as in a molded case circuit breaker. Alternatively, trip unit 12 may include a support structure which is separate from and fastened within the housing of circuit breaker 10.

Stationary contact 16 is electrically connected to a U-shaped, electrically conductive line strap 44 which is electrically connected to a line terminal 46 supported by line strap 44. Moving contact 18 is electrically and mechanically connected to the end of moving contact arm. Contact arm 20 is pivotally supported by a shaft 48 supported by frame 14. Shaft 48 is supported by frame 14 in a conventional manner to provide pivoting support of arm 20 (also see arms 20A, 20B and 20C) between the open position (dashed version of arms 20, 20A, 20B and 20C) and closed position (solid version of arms 20, 20A, 20B and 20C) of arm 20 (also see arms 20A, 20B and 20C).

Contact arm operating mechanism 22 is of the conventional type and operates to move contact arm 20 (also see 20A, 20B and 20C) between its open and closed position. More specifically, an appropriately configured link arrangement 21 connects mechanism 22 with associated arms 20, 20A, 20B and 20C, and through arrangment 21 transmits the force and motion necessary to pivot (rotate) arm 20 (also see 20A, 20B and 20C) between the open and closed positions. As generally discussed above, operating mechanism 22 is also mechanically coupled to tripping mechanism 28 by link 36. In operation, when contact arms 20, 20A, 20B and 20C are closed and current is flowing between load terminal 40 and line terminal 46, tripping mechanism 28 monitors this current and activates mechanism 22 when the current exceeds a predetermined limit for a predetermined period of time. Upon operation of mechanism 22 by tripping mechanism 28, mechanism 22 pivots associated contact arms 20, 20A, 20B and 20C about associated stationary pivots such as shafts 48 to break the electrical connection between contacts 18 and 16.

Operating handle 24 is connected to operating mechanism 22 by an appropriately configured link 50. Handle 24 provides the user of circuit breaker 10 with an interface to contacts 20, 20A, 20B and 20C for purposes of controlling mechanism 22 to move associated arms 20, 20A, 20B and 20C between their opened and closed positions.

Four embodiments of the slidably engageable electrical connection between tripping mechanism 28 and contact arms 20, 20A, 20B and 20C will now be described in detail with reference to the FIGURES. Referring again to FIGS. 1A and 1B, stab 30 may take the form of a single blade which is electrically connected to a jaw assembly 52. Jaw assembly 52 includes two conductive straps 52A and 52B which include openings within which shaft 48 extends to support straps 52A and 52B. Straps 52A and 52B are also supported at a support formation 51 in frame 14 by a screw or rivet 54 and associated compression spring 55 as generally shown in FIGS. 1A and 1B. When jaw 52 is connected to blade 30, electricity is conducted between blade 30 and assembly 52 by a pair 56 and a pair 58 of generally flat, planer and parallel surfaces located between blade 30 and straps 52A and 52B respectively. Electricity may be conducted from assembly 52 to contact arm 20 through shaft 48, but is conducted primarily by contact between a pair 60 and pair 62 of generally flat, planer and parallel contact surfaces located between arm 20 and straps 52A and 52B, respectively. Accordingly, stab 30 and assembly 52 provide a slidable electrical connection between trip unit 12 and arm 20 provided by the stab 30 and jaw assembly 52. Spring 55 is not necessary, but assists in biasing straps 52A and 52B against stab 30 and arm 20 to improve conductivity of the joint.

Figure 2B:
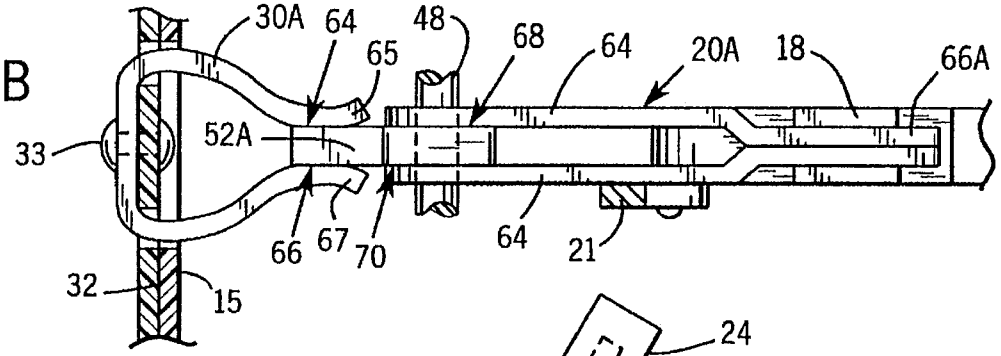
FIG. 2B is a top schematic view of the sliding connection of FIG. 2A.
Figure 2A:
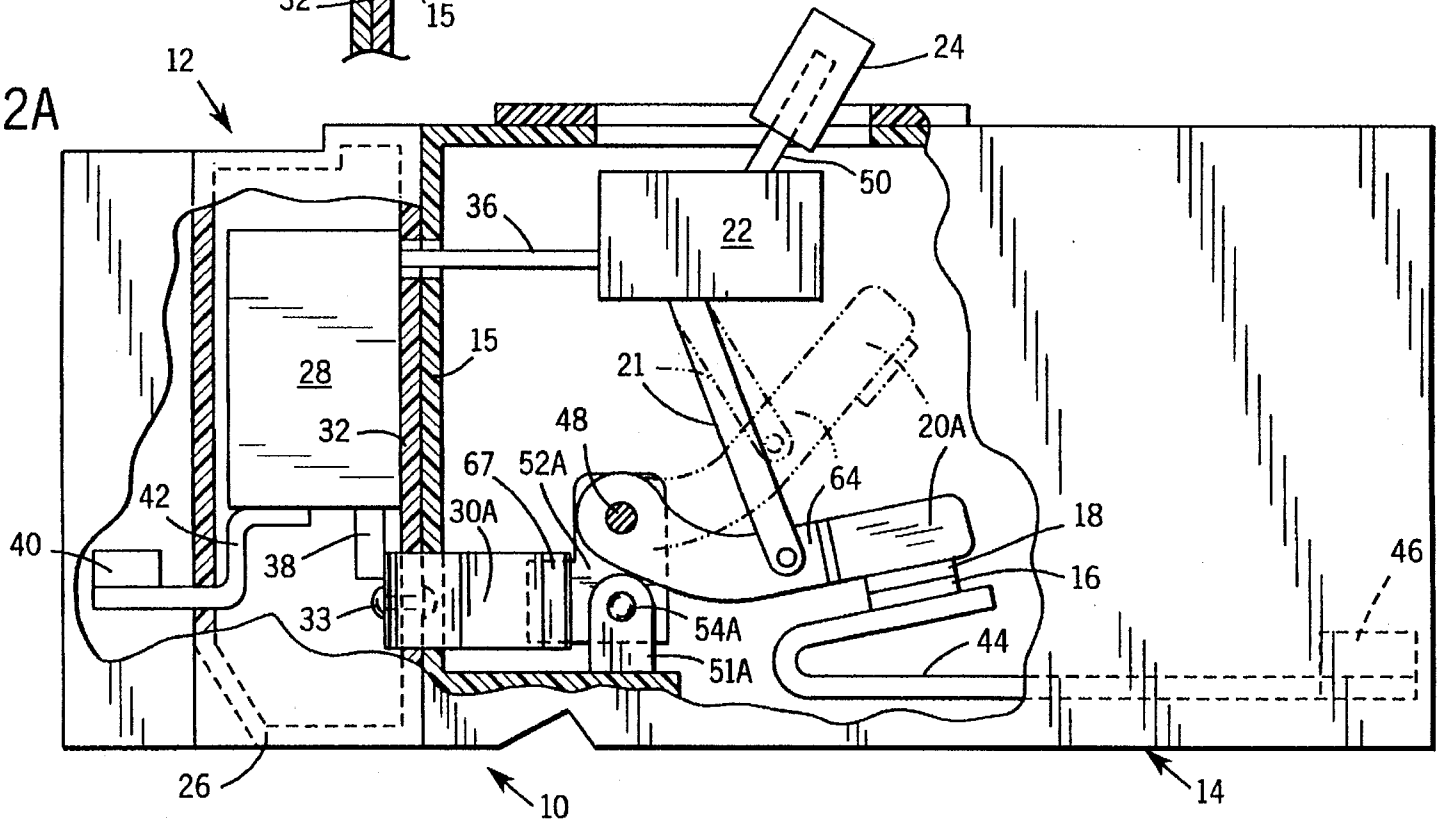
FIG. 2A is a side schematic view of the circuit breaker including a second configuration of the sliding connection between the trip unit and the contact arm.

Referring to FIGS. 2A and 2B, a second embodiment of the slidable electrical engagement between trip unit 12 and contact arm 20A substitutes a C-shaped jaw assembly 30A for blade 30 and includes a contact arm 20A having a pair of substantially parallel blades 74 and 76 joined at one end 66A at which contact 18 is fastened (e.g. soldered). Additionally, jaw assembly 52 is replaced with a L-shaped strap 52A which is supported at a support formation 51A in frame 14 by an appropriate screw or rivet 54A as shown in FIG. 2A. Jaw 30A is supported by wall 32 via an appropriate fastener such as a rivet or screw 33 as oriented in FIGS. 2A and 2B, and is electrically connected to tripping mechanism 28 by conductor 38. When jaw 30A is connected to blade 52A, electricity is conducted therebetween by a pair 66 and a pair of of generally flat, planer and parallel surfaces. Electricity may be conducted between blade 52A and blades 64 through shaft 48, but is conducted primarily by contact between a pair 68 and a pair 70 of generally flat, planer and parallel contact surfaces. Outwardly diverging angled tip portions 65 and 67 may be provided to facilitate engagement of jaw 30A with strap 52A.

Figure 3B:
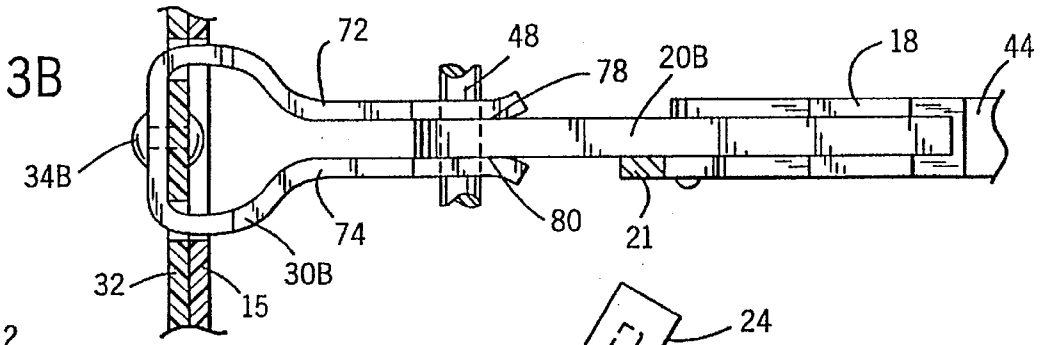
FIG. 3B is a top schematic view of the sliding connection of FIG. 3A.
Figure 3A:
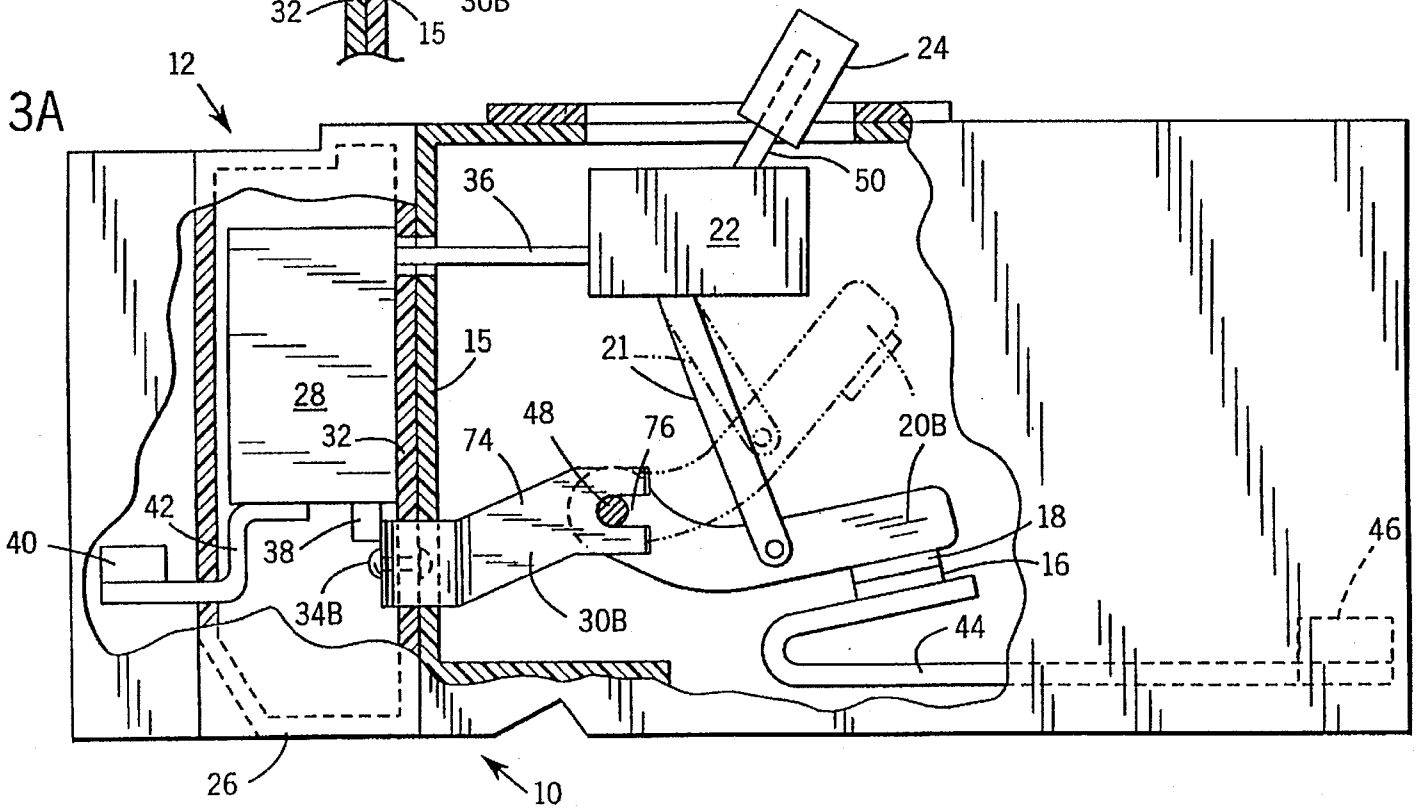
FIG. 3A is a side schematic view of the circuit breaker including a third configuration of the sliding connection between the trip unit and the contact arm.

Referring to FIGS. 3A and 3B, in a third embodiment of the slidable electrical engagement between trip unit 12 and contact arm 20B, blade 30 is replaced with a jaw 30B configured as shown in FIGS. 3A and 3B. More specifically, jaw 30B includes two angled, forked-shaped blades 72 and 74 which each include a shaft engagement depression 76. Jaw 30B is attached to housing wall 32 in a similar manner as that used for jaw 30A using a screw or rivet arrangement 34B. As with jaw 30A, jaw 30B is connected to tripping mechanism 28 by an electrical conductor 38. When assembled, shaft engagement depressions 76 engage shaft 48 and blades 72 and 74 each are located on one side of arm 20B. Accordingly, electricity may be conducted from jaw 30B to arm 20B, through shaft 48, but is conducted primarily through a pair 78 and a pair 80 of generally flat, planer and parallel contact surfaces located between arm 20B and blades 72 and 74, respectively.

Figure 4B:
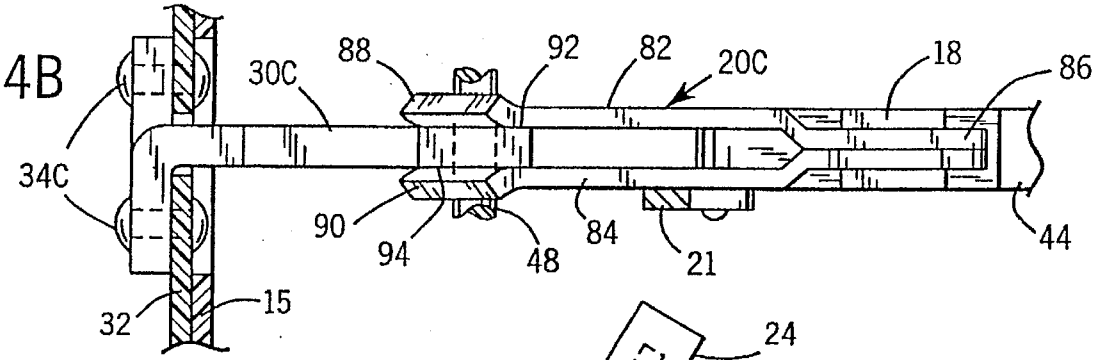
FIG. 4B is a top schematic view of the sliding connection of FIG. 4A.
Figure 4A:
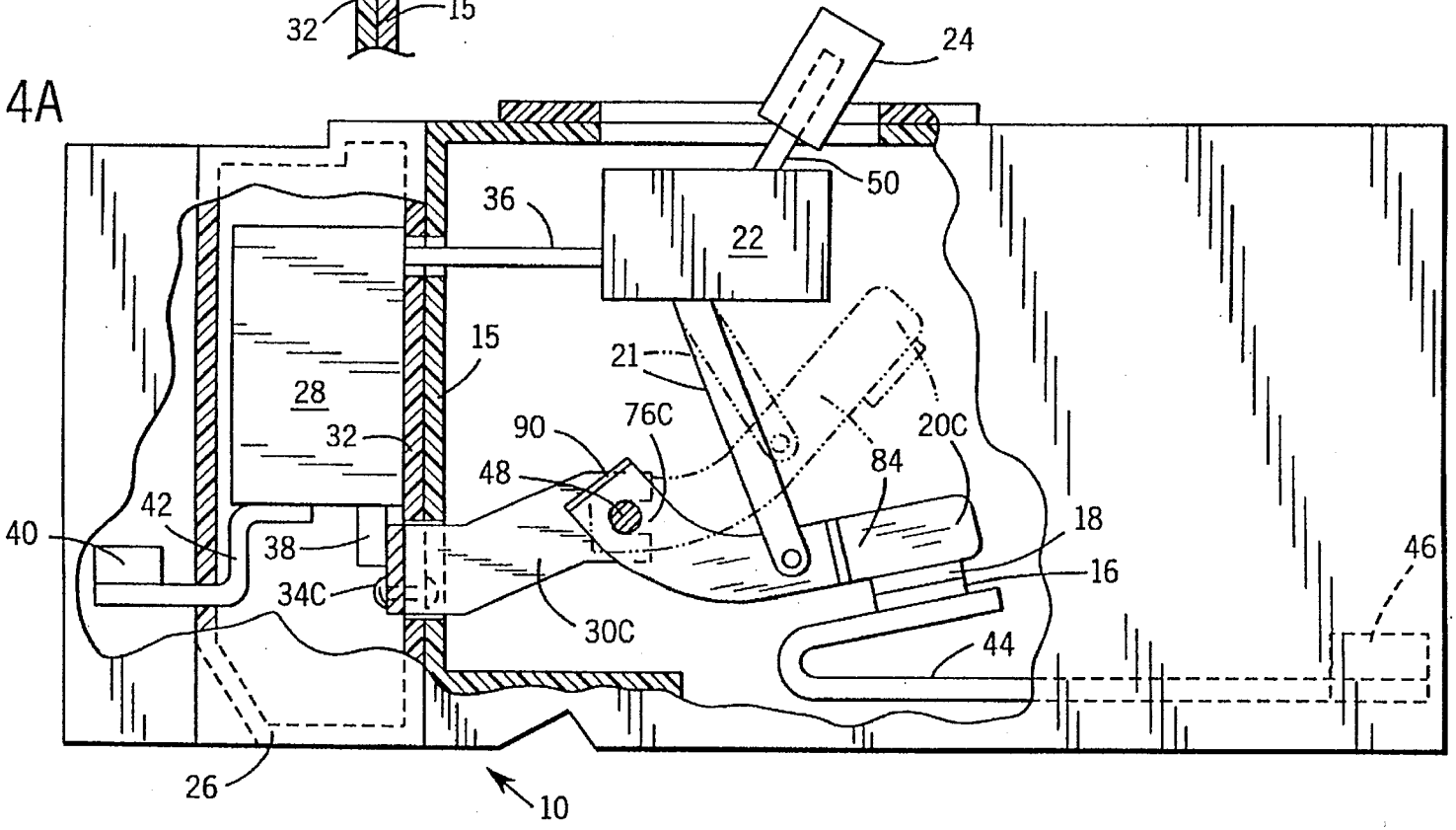
FIG. 4A is a side schematic view of the circuit breaker including a fourth configuration of the sliding connection between the trip unit and the contact arm.

Referring to FIGS. 4A and 4B, another embodiment of the slidable electrical engagement between trip unit 12 and arm 20 is illustrated. In this embodiment of the connection, as with the embodiment of FIGS. 2A and 2B, arm 20C includes a pair of substantially parallel blades 82 and 84 which are connected at an end 86 to which contact 18 is soldered. Blade 30 of the embodiment of FIG. 1 is replaced with a blade 30C including a shaft engagement depression 76C. Blade 30C is connected to housing wall 32 with appropriate rivets or screws 34C as shown in FIGS. 4A and 4B. As with all embodiments, the jaw or blade attached to housing 26 is slid into electrical contact with the associated jaw or blades connected to the contact arms. To facilitate this slidable electrical engagement of the embodiment illustrated in FIGS. 4A and 4B, blades 82 and 84 are provided with angled tip portions 88 and 90, respectively. When blade 30C is engaged with contact arm 20C, electricity may be conducted therebetween through shaft 48, but is conducted primarily by contact between a pair 92 and a pair 94 generally flat, planer and parallel contact surfaces located between blade 30C and blades 82 and 84, respectively.

By way of example, blades and jaws 30, 30A, 30B, 30C and the various embodiments of contact arm 20 may be fabricated from appropriate copper and copper alloys or other appropriate conductors. Additionally, the contact surfaces for conducting electricity in the slidable electrical connection between trip unit 12 and associated contact arms 20, 20A, 20B and 20C may be coated with an appropriate material such as silver or a silver alloy to enhance conductivity and reduce heating at the contact surface interfaces. Furthermore, to enhance conductivity within the slidable electrical connections, the blades or stabs of the associated jaw portions are fabricated such that the distance between the parallel blades is less than the associated blade which lays therebetween. Accordingly, when the associated blade is engaged with the blades of the jaw arrangement a contact pressure is applied therebetween to thus increase conductivity and reduce heating at the connection. Furthermore, as discussed above in reference to FIGS. 1A and 1B, spring biasing can be used to increase contact pressure. Similarly, blades 64, and blades 82 and 84 of arms 20A and 20C, respectively are fabricated with a distance therebetween less than the associated thickness of respective blades 52 and 30C. As discussed above, this configuration increases the conductivity within the electrical connection.

Figure 5:
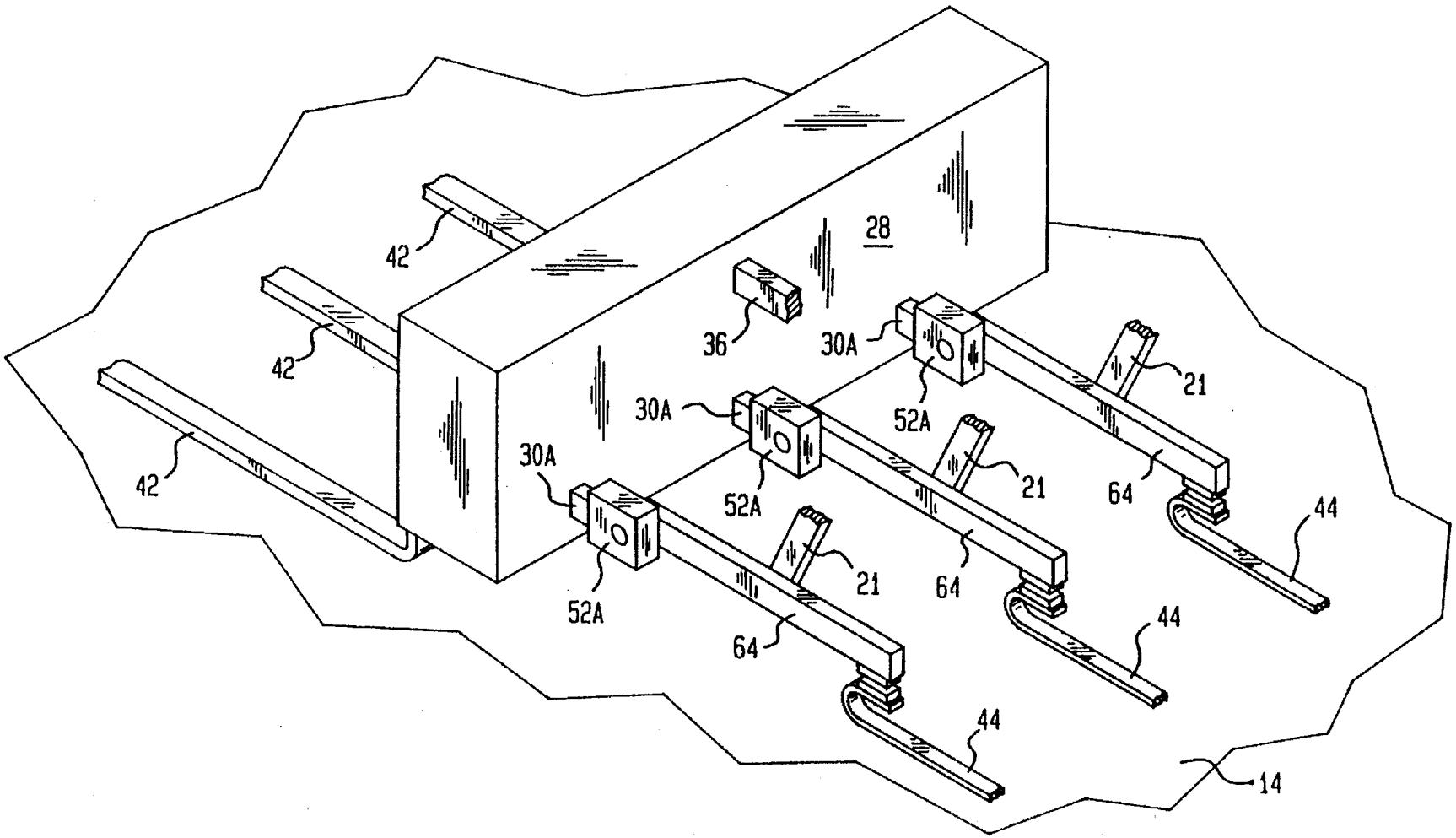
FIG. 5 is a schematic view of a three-phase circuit breaker including an embodiment of the blade and jaw construction for each phase.

It will be understood that the description above is of the preferred exemplary embodiment of the present invention and that the invention is not limited to the specific forms shown and described. For example, trip unit 12 may be of the type which plugs into the circuit breaker and is provided with a slidable electrical connection between both the contact arm 20 and load terminal 40 where load terminal 40 is mechanically supported by frame 14. Additionally, the embodiments of the slidable electrical connection discussed above are discussed in the context of a single phase. However, this connection may be used with single or multiple (e.g. three-phase) phase circuit breakers. FIG. 5 shows schematically a three-phase circuit breaker including an embodiment of the inventive blade and jaw construction for each phase. Like reference numerals from previous FIGURES are used to identify like parts in FIG. 5. Other substitutions, modifications, changes and omissions may be made in the design and arrangement of the preferred embodiment without departing from the spirit of the invention as expressed in the appended claims.

What is claimed is:

1. A circuit breaker comprising:

a circuit breaker frame;

a contact arm operating mechanism supported by the frame;

a contact arm, adapted for carrying a current, pivotally supported by a shaft supported by a frame, the contact arm being mechanically coupled to the operating mechanism wherein the operating mechanism is configured to move the contact arm between an open position and a closed position;

a trip unit configured to activate the operating mechanism to move the contact arm to the open position if the current flowing through the contact arm exceeds a limit;

a first generally flat surface in electrical communication with the contact arm; and a second generally flat surface in electrical communication with the trip unit, the flat surfaces being slidably engaged to conduct electricity between the contact arm and the trip unit, the flat surfaces further being slidably disengagable while the contact arm remains pivotally supported by the shaft.

2. The circuit breaker of claim 1, wherein the first generally flat surface is integral with a jaw connected to the trip unit and the second generally flat surface is integral with a blade electrically connected to the contact arm.

3. The circuit breaker of claim 2, wherein the blade has a thickness, and the jaw includes a third generally flat surface, the first and third generally flat surfaces being elastically supported in a generally parallel relationship with a distance therebetween less than the thickness of the blade such that the blade deflects the first and third generally flat surfaces apart when located therebetween, and the first and second generally flat surfaces are in electrical contact.

4. The circuit breaker of claim 1, wherein the trip unit includes a housing, and the first generally flat surface is formed on one of a blade and jaw supported by the housing.

* * * * *